US012447523B2

(12) United States Patent
Weiss et al.

(10) Patent No.: US 12,447,523 B2
(45) Date of Patent: Oct. 21, 2025

(54) WIRE TWISTING DEVICE

(71) Applicant: Textron Aviation Inc., Wichita, KS (US)

(72) Inventors: Jesse Weiss, Wichita, KS (US); Ryan Lynch, Wichita, KS (US)

(73) Assignee: Textron Aviation Inc., Providence, RI (US)

( * ) Notice: Subject to any disclaimer, the term of this patent is extended or adjusted under 35 U.S.C. 154(b) by 454 days.

(21) Appl. No.: 18/170,771

(22) Filed: Feb. 17, 2023

(65) Prior Publication Data

US 2024/0278310 A1 Aug. 22, 2024

(51) Int. Cl.
*B21F 7/00* (2006.01)
*B21F 15/04* (2006.01)

(52) U.S. Cl.
CPC ..... *B21F 7/00* (2013.01); *B21F 15/04* (2013.01)

(58) Field of Classification Search
CPC ..... B21F 15/00; B21F 15/02; B21F 15/04; B21F 7/00; B65B 13/22; B65B 13/28; B65B 13/285; B65B 13/025; B65B 13/04; B65B 13/06; B65B 27/10; B25B 25/00; E04G 21/123
See application file for complete search history.

(56) References Cited

U.S. PATENT DOCUMENTS 11,309,105 B2 * 4/2022 Ciapala ..... H01B 13/0235
11,466,466 B2 * 10/2022 Kawai ..... E04G 21/123
2013/0014852 A1 1/2013 Hayden et al.

FOREIGN PATENT DOCUMENTS

WO WO-2008013142 A1 * 1/2008 ..... E04G 21/123

OTHER PUBLICATIONS

Translation of WO-2008013142.*

* cited by examiner

*Primary Examiner* — Bobby Yeonjin Kim
(74) *Attorney, Agent, or Firm* — Avek IP, LLC

(57) ABSTRACT

A wire twisting device may include a driven rotating mechanism having a groove configured to receive two wires, an electric motor associated with an encoder, wherein the encoder is configured to generate an electrical signal corresponding to changes in rotation of the electric motor, a drive gear mechanically coupled with the electric motor for rotating the driven rotating mechanism, a current sensor on a printed circuit board configured to detect an electrical current to the electric motor and generate a voltage that corresponds to the amount of electrical current, and a control unit configured to perform steps comprising: receiving the electrical signal generated by the encoder, receiving the voltage generated by the current sensor, determining an amount of torque applied to the two wires; and when the amount of torque exceeds a predetermined limit, communicating a control signal to reduce the electrical current provided to the electric motor.

20 Claims, 16 Drawing Sheets

WIRE TWISTING DEVICE

1. FIELD

Embodiments of the invention relate generally to powered handheld devices, and more specifically to a handheld device for twisting together strands of wire.

2. RELATED ART

Various solutions have been proposed for twisting together strands of wire. For example, U.S. Patent Application Publication No. 2013/0014852 to Hayden et al. describes a wire tie system for twisting of a single wire about itself, the single wire having a fixed end and a free end. A driven gear has a slot for receiving a stationary portion of the wire and a hole in which the free end of the wire is inserted. As the driven gear turns, the free end is wound about the stationary end. U.S. Patent Application Publication No. 2021/0020337 to Ciapala et al. describes an apparatus for center twisting conductor wires that includes a gripping mechanism having a U-shaped groove with an inflatable U-shaped bladder for gripping central portions of the wires. A rotational member has a pair of gears that engages with a toothed edge of the gripping mechanism for rotating the gripping mechanism. U.S. Patent Application Publication No. 2019/0257097 to Kawai et al. describes an electric power tool for tying rebar with a tying string involving a tying-string twisting operation which is powered by a twisting motor. A torque acting on the twisting motor is determined by using the measured torque to adjust the operations of the twisting motor.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

A wire twisting device and a method for twisting wire with a wire twisting device is described herein. The wire twisting device includes: a driven rotating mechanism having a groove, wherein the groove includes a first side and a second side configured to receive a first wire and a second wire, respectively; an electric motor associated with an encoder, wherein the encoder is configured to generate an electrical signal corresponding to changes in rotation of the electric motor; a drive gear mechanically coupled with the electric motor for rotating the driven rotating mechanism, wherein the driven rotating mechanism is configured to twist the first wire and the second wire about one another; a printed circuit board having an integrated circuit current sensor configured to detect an electrical current to the electric motor and generate a voltage that corresponds to the amount of electrical current; and a control unit configured to perform steps including: receiving the electrical signal generated by the encoder; receiving the voltage generated by the current sensor; determining an amount of torque applied to the first wire and the second wire; and when the amount of torque exceeds a predetermined limit, communicating a control signal to reduce the electrical current provided to the electric motor.

The method of twisting wire with a wire twisting device includes: receiving a first wire and a second wire in the wire twisting device, the device having an electric motor configured for rotating a driven rotating mechanism, wherein the driven rotating mechanism includes a groove having a first side and a second side configured to receive the first wire and the second wire, respectively; generating an electrical signal via an encoder, wherein the electrical signal indicates changes in rotation of the electric motor; generating a voltage via a printed circuit board having an integrated circuit current sensor, wherein the voltage corresponds to an electrical current to the electric motor; receiving the electrical signal via a motor controller communicatively coupled with the a control unit, a power supply and the electric motor; receiving the voltage via the control unit communicatively coupled with the motor controller; estimating in real time, via the control unit, an amount of torque applied to the first wire and the second wire based on the voltage; and communicating, via the control unit, a control signal for reducing the amount of electrical current provided to the electric motor.

BRIEF DESCRIPTION OF THE DRAWING FIGURES

Embodiments of the invention are described in detail below with reference to the attached drawing figures, wherein.

Figure 1:
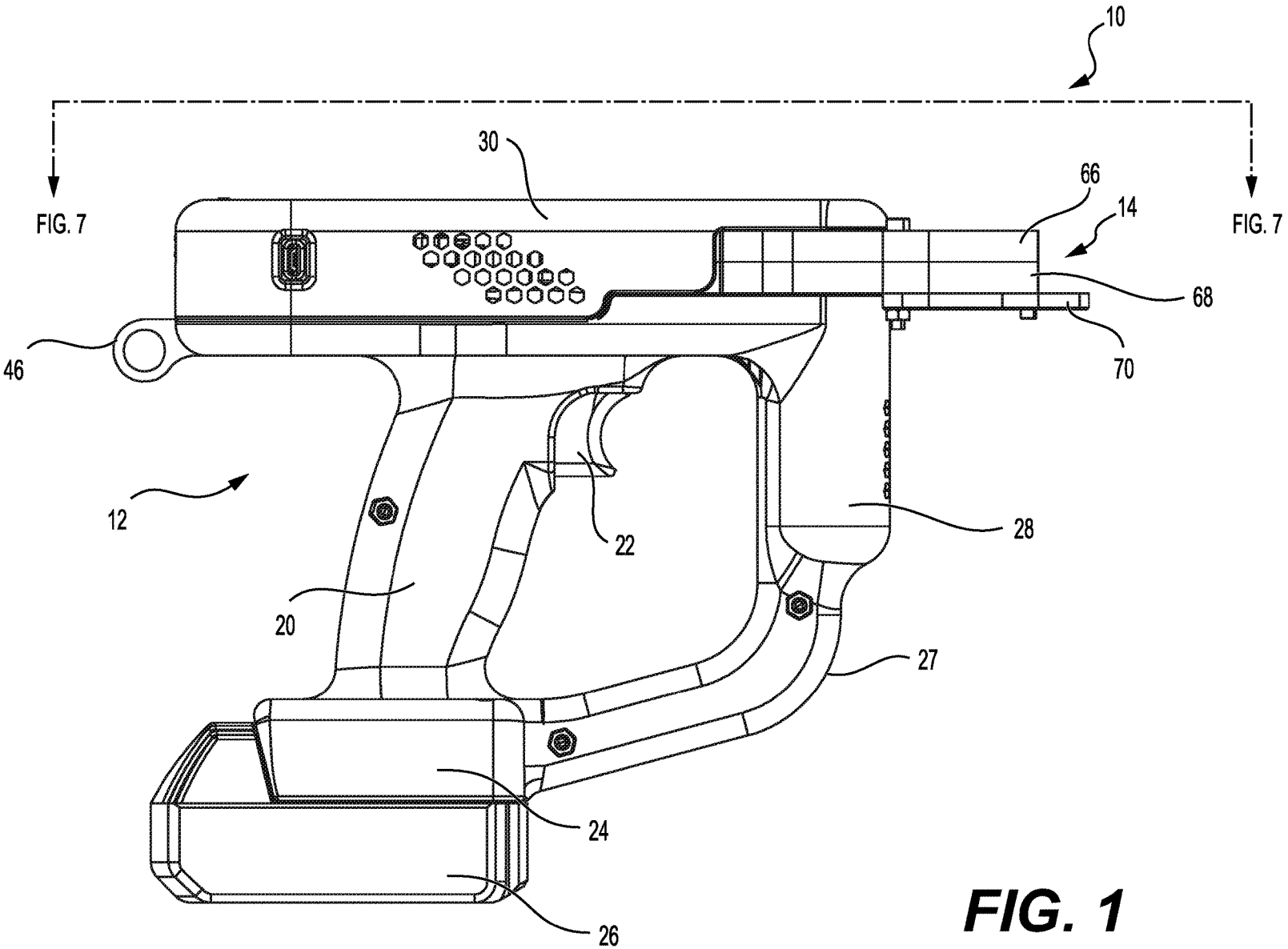
FIG. 1 illustrates a side, elevational view of a wire twisting device and includes a rechargeable battery installed on a base of the device, in an embodiment.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Embodiments disclosed herein describe a wire twisting tool for twisting wires used to hang parts on picture frame racks for processing through a phosphoric acid anodizing line. The wire twisting tool has a gun-like shape with a jaw or reduction gearbox that is used to twist two wires together. The jaw has a modified output gear with two slots separated by a wall. The two wires slide transversely into the two slots of the jaw and extend transversely to the device on each side of the jaw. One wire goes into each slot and the output gear is then rotated to twist the wires together. The tool can be wirelessly updated, and the health or performance of the tool can be wirelessly monitored. The system is configured to prevent damage to the device by automatically stopping or homing the motor of the device before it can overheat due to overstress. In addition, the system is configured to prevent inadvertent breakage of the wires being twisted due to overtwisting. The wire twisting tool monitors the applied torque, torque applied to the two wires being twisted, and stops twisting if a threshold torque has been reached to avoid breaking the wires. Further, the system is configured to estimate the wire gauge by monitoring the applied torque and comparing the applied torque to previously collected data sets The present system provides advantages over current methods of wire twisting by minimizing injuries, such as carpal tunnel syndrome and repetitive strain injuries. The present system is designed to provide a balanced feel in a user's hand while also providing sufficient power for wire twisting.

Figure 2:
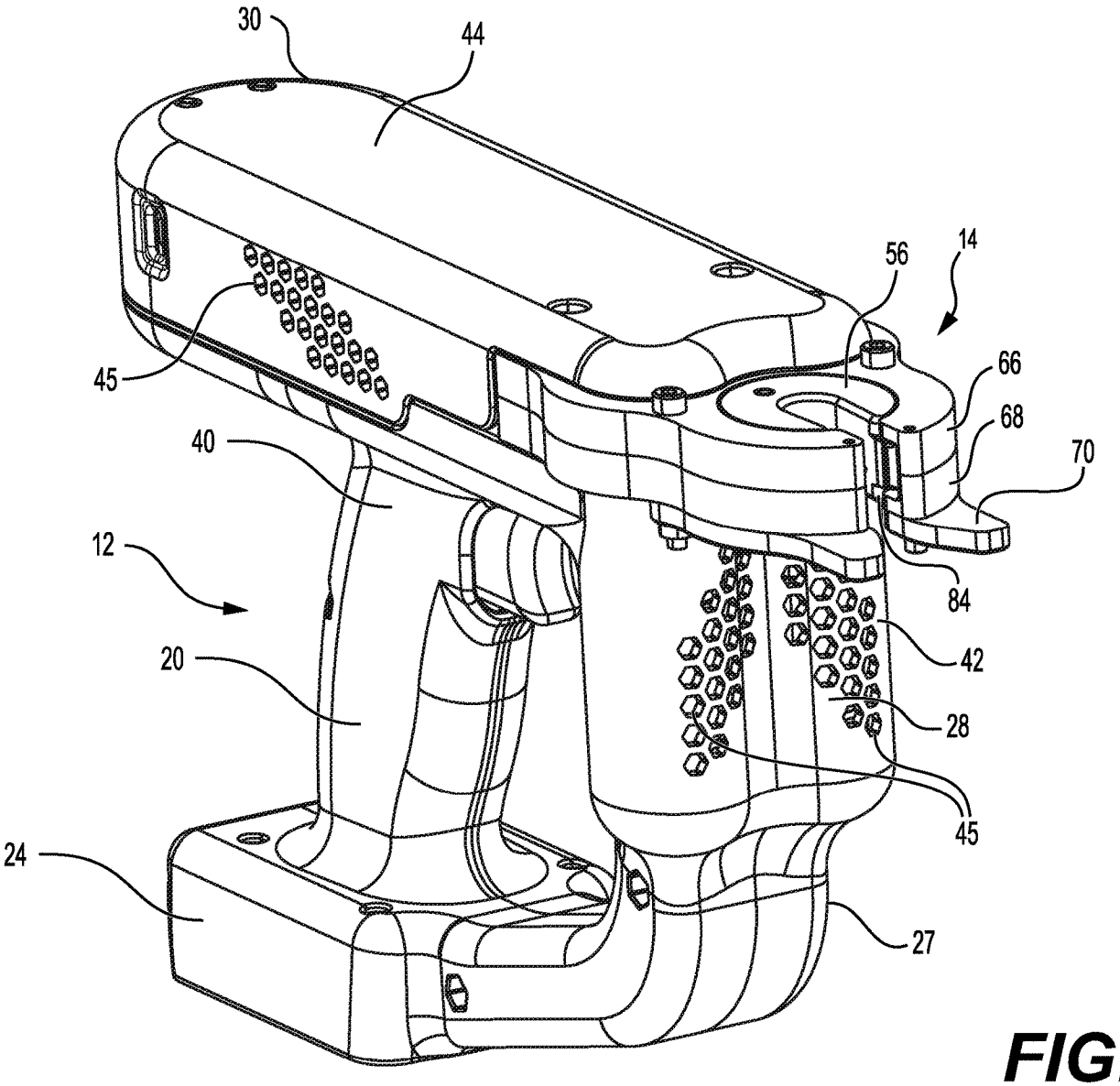
FIG. 2 illustrates a front, perspective view of the wire twisting device in FIG. 1, without the rechargeable battery, in an embodiment.

Embodiments disclosed herein include a handheld, electric-powered device or tool 10 for twisting two wires 11. As shown in FIGS. 1-2, the wire twisting device 10 has a body 12 with a jaw or reduction gearbox 14 extending therefrom that is used to twist the two wires 11 together. The body 12 includes a grip portion or handle 20 with a trigger 22, a base 24 where a power source or rechargeable battery 26 may slide onto for operation, a secondary handle 27 with a motor housing 28, and an upper body 30 housing some of the electronic components of the device 10.

The shell or casing portion of the body 12 includes a first body member 40 on a first side of the body 12, a second body member 42 on a second side of the body 12, and a top body member 44. The body members 40, 42 and 44 snap together and/or are fastened together with fasteners. The top body member 44 may be removed to replace internal components of the device 10, such as for replacement of the gearbox 14. The body houses internal portions of the device 10, detailed below. The body members may include perforations or ventilation holes 45. On the body 12 opposite the gearbox 14 is a hook or loop or lug 46 extending from between the first body member 40 and the second body member 42. The lug 46 extends from the body 12 and is accessible by a user for hanging or hooking the device 10.

The gearbox 14 extends from the top body member 44, over the first and second body members 40 and 42, and interfaces with the two wires 11. The gearbox 14 includes a rotating mechanism or modified output gear 56 that defines a U-shaped groove 57 configured to receive the two wires 11. The U-shaped groove 57 is formed in and extends inward from a perimeter of the rotating mechanism 56 to slightly past approximately a center 61 of the rotating mechanism 56 and includes two slots 60 with a separating member or wall 62 therebetween, extending from the inner end of the U-shaped groove 57 of the rotating mechanism 56. The width of the U-shaped groove 57 or two slots 60 is slightly greater than the diameters of the two wires 11 and the separating member 62.

Figure 3:
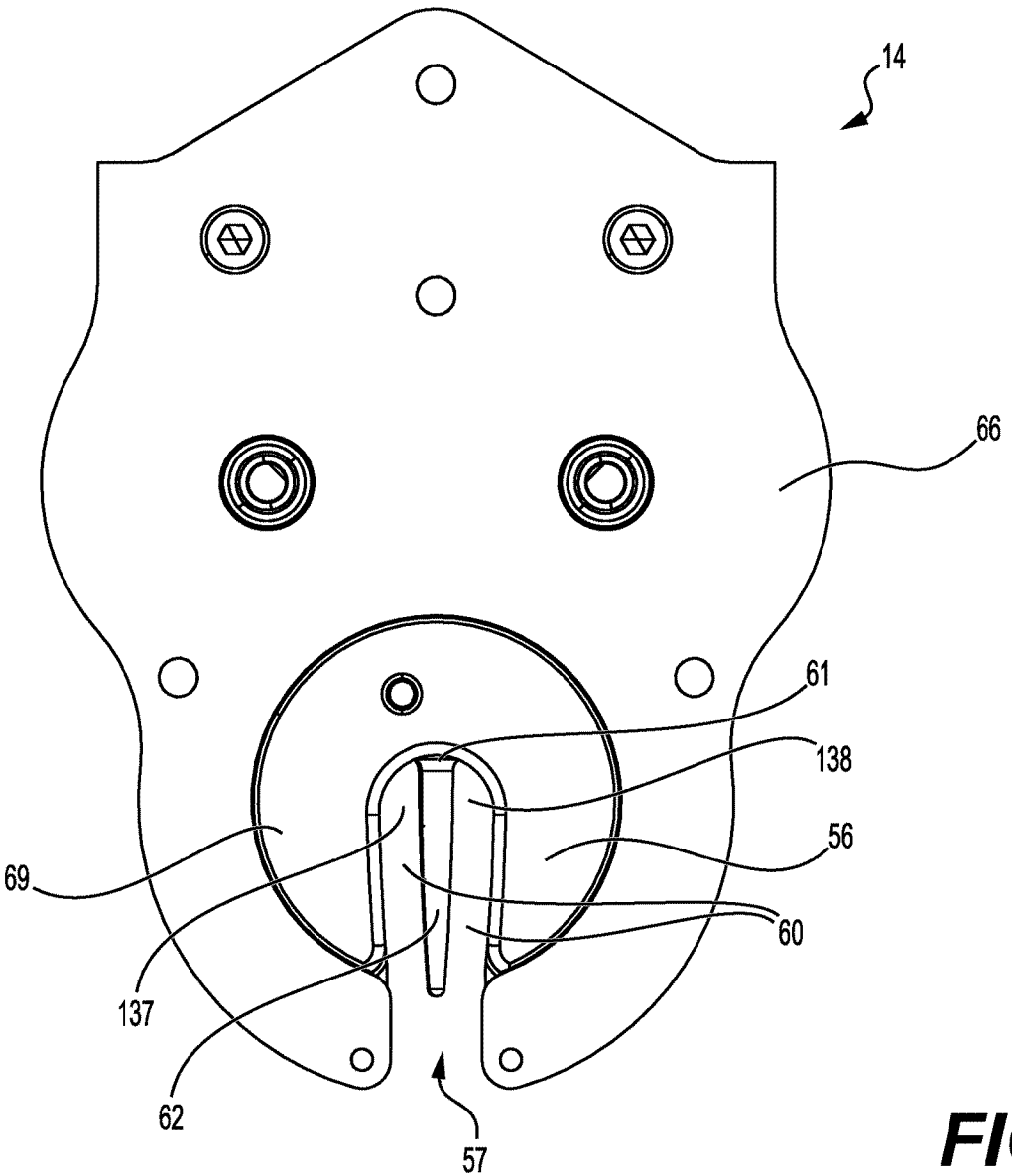
FIG. 3 illustrates a top, plan view of a gearbox of the wire twisting device in FIG. 1, the gearbox including a casing, a rotating mechanism with a groove and a separating member, and an opening configured to receive two wires to be twisted, in an embodiment.
Figure 4:
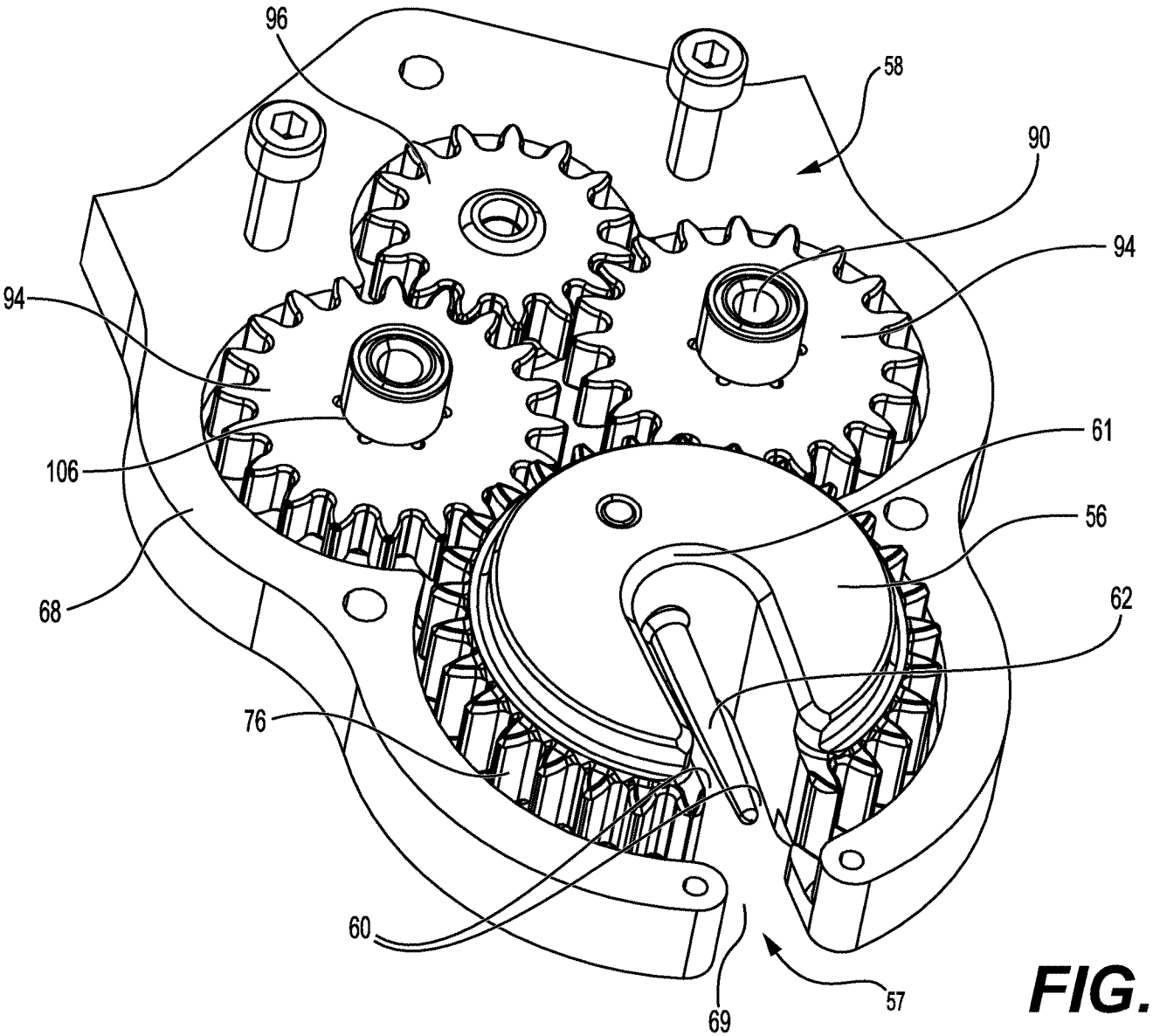
FIG. 4 illustrates a top, perspective view of the gearbox in FIG. 3, an upper casing removed to show a gear train, including the rotating mechanism with the groove and the separating member, in an embodiment.
Figure 5:
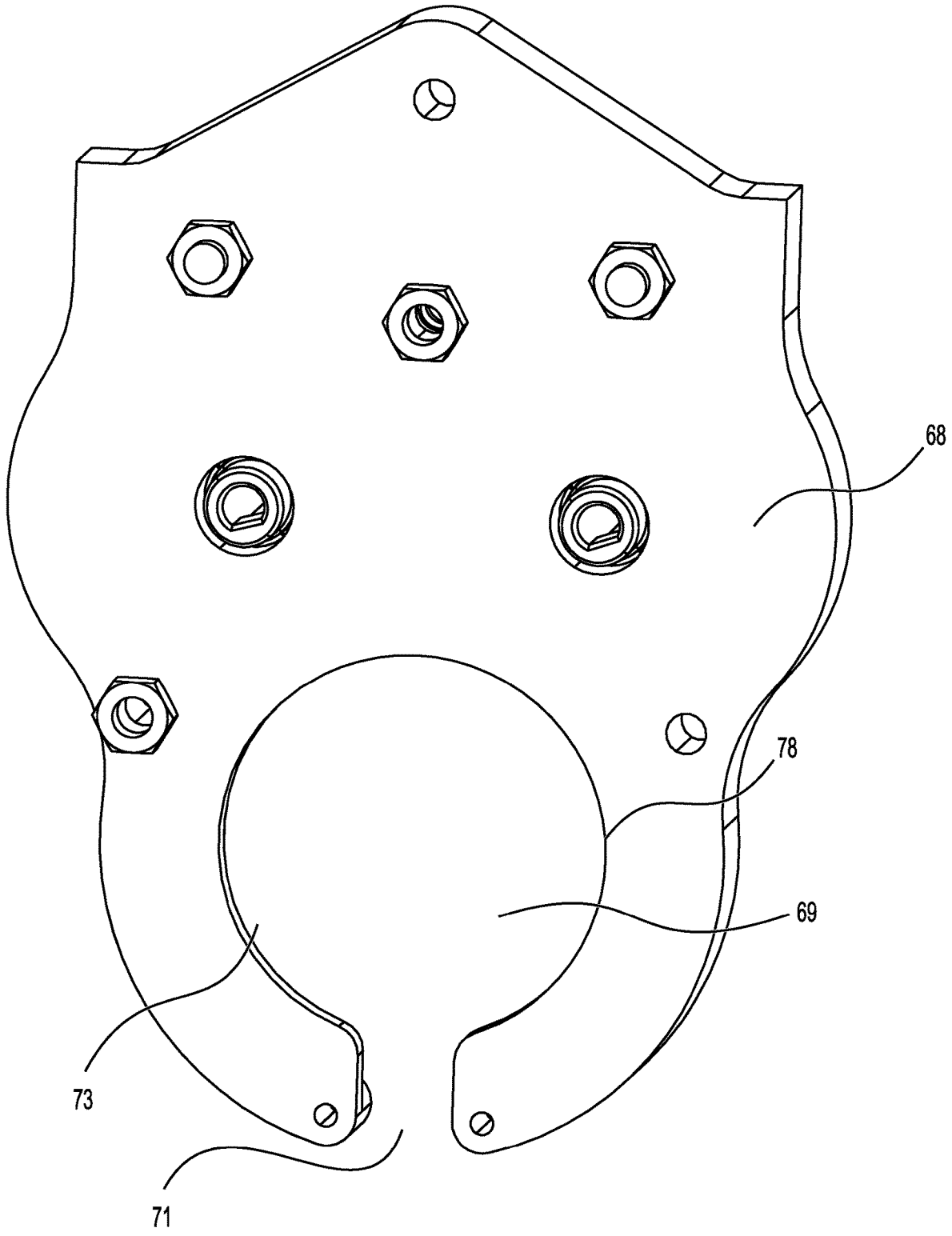
FIG. 5 illustrates a top view of an upper casing or bottom view of a lower casing of the gearbox in FIG. 3, including assembly hardware and gear train input shafts, a gear train removed, in an embodiment.

Details of the gearbox 14 are shown in FIGS. 3-5. The rotating mechanism 56 is part of a gear train 58 that is mounted or secured within the gearbox 14, the gearbox 14 including an upper casing 66 and a lower casing 68 and the gearbox 14 removably secured to the body members 40, 42 and 44. The upper casing 66 and the lower casing 68 are formed similarly and both define apertures 69, the upper casing 66 defining an upper aperture and the lower casing 68 defining a lower aperture, extending from a perimeter of the casings 66 and 68 to at least the end of the U-shaped groove 57 of the rotating mechanism 56. The apertures 69 may be at least similar in size and shape to the two slots 60 of the rotating mechanism 56. The apertures 69 are at least approximately the width of the two slots 60, such that the two wires 11 can be inserted in the two slots 60 of the rotating mechanism 56 with the separating member 62 extending between the two wires 11 when the apertures 69 and the two slots 60 of the rotating mechanism 56 are in alignment. In an embodiment shown in the figures, first portions 71 of the apertures 69 formed in the casings 66 and 68 extend from the perimeter of the casings 66 and 68 inward and are approximately a width of the U-shaped groove 57 of the rotating mechanism 56, circular-shaped second portions 73 of the apertures 69 are defined by and formed in the casings 66 and 68. The second portions 73 are similar in size to the center portion of the rotating mechanism 56 from which the teeth 76 extend such that the casings 66 and 68 are in a covering relationship with the teeth 76 of the rotating mechanism 56. The second portions 73 further serve as an integral bushing that supports and holds captive the rotating mechanism 56.

Figure 6:
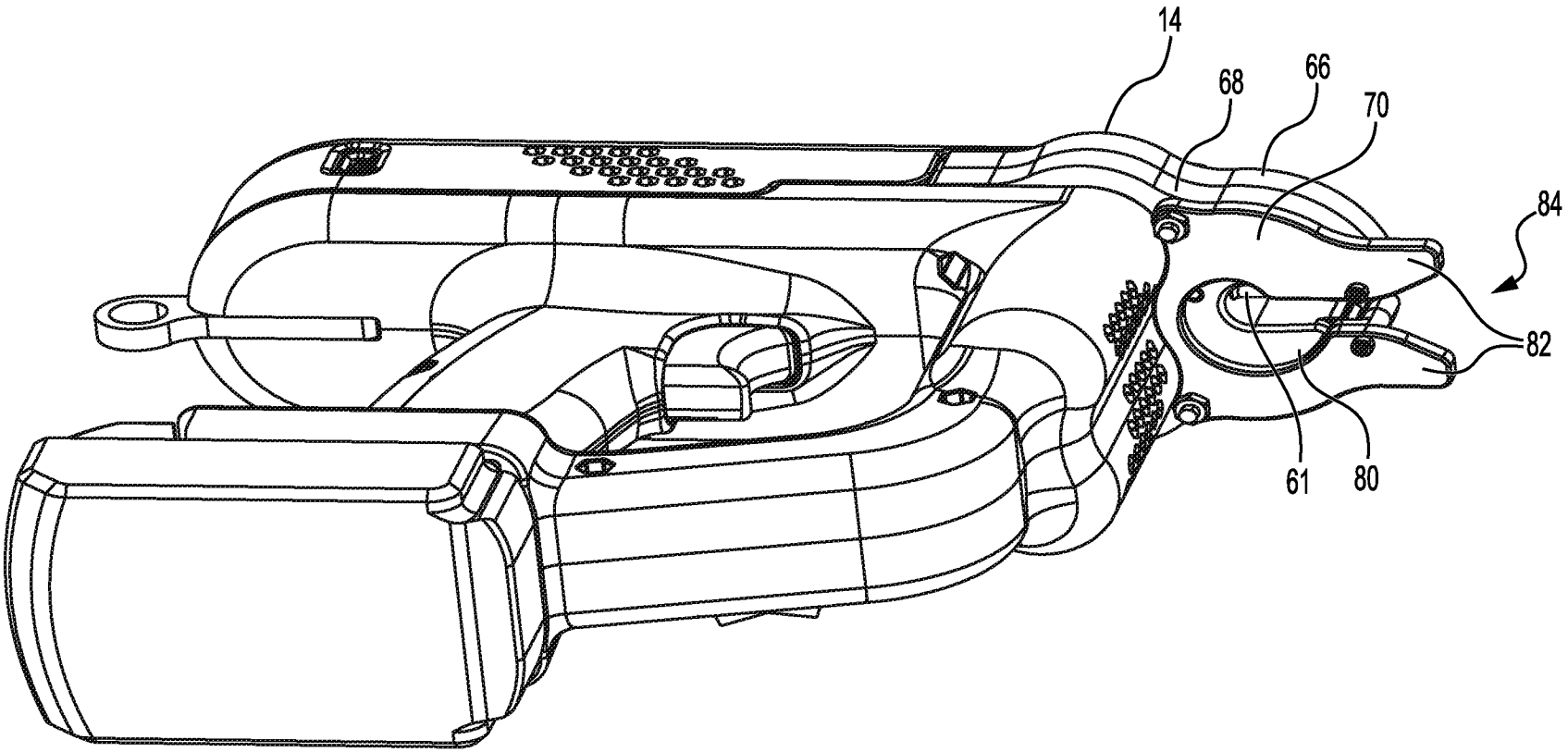
FIG. 6 illustrates a bottom, perspective view of the wire twisting device in FIG. 1, showing a wire guide, in an embodiment.

A wire guide 70, as shown in FIG. 6, is secured to the bottom face of the gearbox 14 or of the lower casing 68. The wire guide 70 includes an opening 80 that corresponds to at least the two slots 60 when the opening 80 is in alignment with the two slots 60 and is formed between two guiding members 82 of the wire guide 70. The opening 80 is at least approximately the width of the two slots 60 and extends to at least the end of the U-shaped groove 57 of the rotating mechanism 56. When the two slots 60 in the rotating mechanism 56 are aligned with the apertures 69 and the opening 80 of the wire guide 70, an integrated passage or opening 84 is formed for the two wires 11 to be inserted and slid toward the center 61 of the rotating mechanism 56 of the device 10. The center 61 of the rotating mechanism 56 is open or uncovered by other parts of the device 10 such that the two wires 11 being twisted extend transversely through the rotating mechanism 56, one wire on each side of the separating member 62 and in each slot of the two slots 60 of the rotating mechanism 56. Actuation of the rotating mechanism 56 with the two wires 11 inserted into the two slots 60 of the rotating mechanism 56 causes the two wires 11 to be twisted. As shown in the figures, the two guiding members 82 extend on each side of the opening 84 and expand outward, the opening 80 of the wire guide 70 forming a funnel-like entry that facilitates inserting the two wires 11 into the opening 84 and helps guide the wires toward the center 61 and into the two slots 60 of the rotating mechanism 56.

The gearbox 14 includes the gear train 58 having the four externally toothed gears, including the larger, driven rotating mechanism 56, two drive gears 94 and a smaller driven gear 96, such that teeth of the gears in the gear train are in engagement. As shown in the drawings, the two drive gears 94 are positioned adjacent the rotating mechanism 56. Actuation of the rotating mechanism 56 causes the two slots 60 of the rotating mechanism 56 to rotate past the drive gears 94. As the two slots 60 rotate past each of the drive gears 94, the drive gear 94 adjacent the two slots 60 becomes disengaged from the rotating mechanism 56 due to the size and location of the two slots 60 relative to the gear teeth on the adjacent drive gear 94. The smaller driven gear 96 serves as a redundant power transmission path from the disengaged drive gear 94, through the still-engaged drive gear 94, and to the rotating mechanism 56. The smaller driven gear 96 also physically synchronizes the disengaged drive gear 94 with the rotating mechanism 56 such that as the two slots 60 complete their transit past the disengaged drive gear 94, the teeth of the disengaged drive gear 94 are able to remesh with the rotating mechanism 56, avoiding failure of the gear train 58.

The two drive gears 94 of the gear train 58 are each driven by one of two motors 88, each motor 88 having a shaft or adapter shaft 90 connecting the motors 88 to the drive gears 94 and driving the respective drive gear 94 of the gear train 58 to transmit torque or power from the respective motor 88 to the rotating mechanism 56. In one embodiment, the motors 88 are 25D Metal Gearmotors manufactured by Pololu. In an embodiment, the motors 88 are brushed motors. In one embodiment, an adapter shaft 90 may connect the motor shaft 90 to the gearbox 14. It is foreseeable that other types of motors and configurations of motors 88 and gears 94 producing torque sufficient to twist the two wires 11 could be used in the invention, such as using one motor to drive one drive gear in the reduction gearbox 14.

Figure 7:
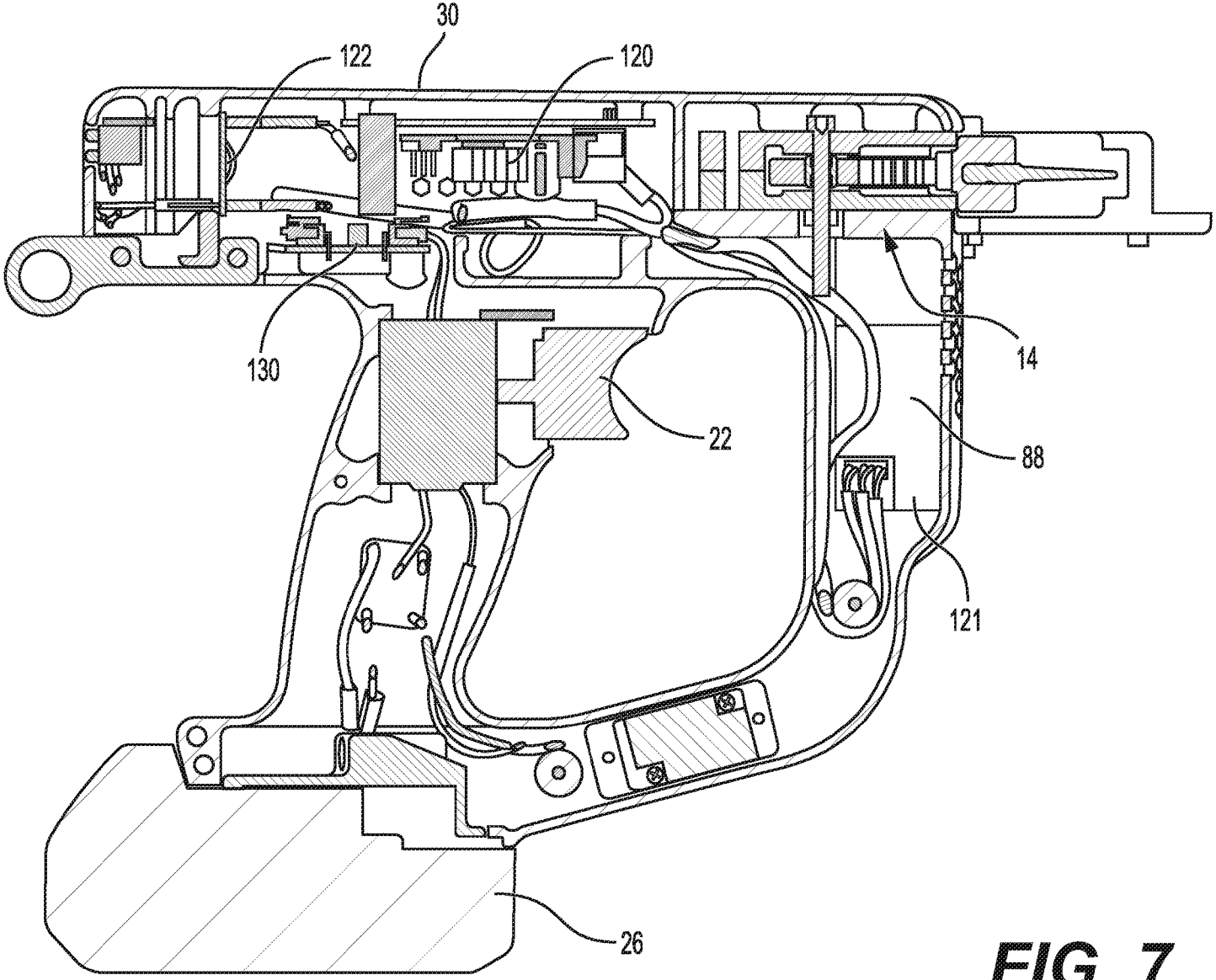
FIG. 7 illustrates a cross-sectional view of the wire twisting device in FIG. 1, including the rechargeable battery and illustrating a relative position of the internal components, in an embodiment.

As shown if FIG. 7, the motors 88 may be positioned within the motor housing 28 of the secondary handle 27. The shafts or adapter shafts 90, rotatably connected to the motors 88, extend upward through top portions of the body members 40 and 42 and are mounted in a bore 106 formed in the center of each drive gear 94. The shafts 90 may optionally be formed on the drive gears 94 and extend downward through the top portions of the body members 40 and 42, rotatably connected to the motors 88. The specifications and requirements of the motors 88 and the gearbox 14 would be understood by a person having ordinary skill in the art. In one embodiment the motors 88 are electric servo motors.

In the embodiment shown, the rechargeable battery 26 is the power source that powers the motors of the device 10. The rechargeable battery 26 may be understood by a person having ordinary skill in the art to be the type of battery used in a cordless power tool, such as a lithium-ion battery pack. The installed battery 26 stores energy and then releases it when an electrical circuit is completed, such as by pressing an "on" switch and/or compressing the trigger 22, actuating the device 10 and/or the motors 88. Upon depletion of the energy in the battery 26, the rechargeable battery 26 must be recharged with energy from a recharger (not shown) and replaced on the device 10 for continued actuation of the device 10.

The trigger 22 on the device 10 is compressible or operable by a user to selectively complete the electrical circuit, engaging and connecting the power source or battery 26 to the components. The trigger 22 is configured to actuate or initiate a wire twisting cycle of the motors 88 when the trigger 22 is compressed and configured to open or break the electrical circuit and stop or pause the wire twisting cycle when the trigger 22 is not compressed.

The trigger 22 is positioned on the upper, inside portion of the grip portion 20 of the device 10 for ergonomic hand positioning and comfort to a user. The trigger 22 may be a small, flattened lever that is depressible with the index finger or another foreseeable type of trigger, such as a push-button switch. One of various embodiments of the trigger 22 may be used in the device 10 as would be understood by one skilled in the art. In one embodiment, the trigger 22 may be a pressure-sensitive or variable speed trigger such that light pressure activates a slow speed in the motors 88 while heavy pressure produces an increased speed of the motors 88. In another embodiment, the trigger 22 may be a reversible trigger. In yet another embodiment, the trigger 22 may include a trigger lock such that the motors 88 and the gearbox 14 of the device 10 continue to be actuated without compressing or squeezing the trigger 22 after an initial compression of the trigger 22.

A separate power switch (not shown) may be electrically connected to the power source or battery 26 of the device 10 to provide electrical power to limited tool functions without actuating or initiating the wire twisting cycle. The separate power switch may be located and oriented to also serve as an emergency power stop to disconnect power to the device 10 to stop the wire twisting cycle.

A motor controller 120 incorporates a driver circuit or an integrated motor driver that regulates or controls the operation of the motors 88, including speed, torque, and direction of each motor 88 in a closed-loop feedback control system. In one embodiment the motor controller 120 is a Basicmicro RoboClaw 2×15A motor controller manufactured by Basicmicro. Each motor 88 is associated with an encoder 121 that monitors and/or detects movements and/or conditions of the motor 88, including changes in rotation, speed, position and/or mechanical output of the respective motor 88 The encoders 121 generate an electrical signal that corresponds to information or data of the motion of the motors 88 that is communicated to, received and processed by the motor controller 120. In the embodiment shown, a rotary position encoder 121 is integrated into the housing of each electric motor 88. Each encoder is an integral Hall-effect quadrature encoder 121 positioned on the shaft 90 of the respective motor 88 and signals changes in rotation of the motor 88. As a result of the electrical signal from the encoders 121, the motor controller 120 outputs a pulse-width modulation signal back to the motors 88, causing the motors 88 to move to a desired position. The motor controller 120 also automatic manages other system conditions, including under/overvolt protection and current limiting. The settings of the motor controller 120 are configurable by a user.

A master control unit or server or microcontroller 122 monitors system parameters, including, but not limited to, battery voltage, trigger state, current drawn by the motor, rotation of the motor and other secondary control inputs, coordinates various tool functions, and runs and executes downloaded programming. In one embodiment the master control unit 122 is an Arduino MKR WiFi 1010 microcontroller manufactured by Arduino. In one embodiment the master control unit 122 may activate one or more system status LEDs (not shown) on an aft end of the top body member 44 in the cavity behind master control unit 122. The master control unit 122 receives digital signals from the motor controller 120. There is a bidirectional, data link between the master control unit 122 and the motor controller 120 which allows the master control unit 122 to orchestrate the functions of the motor controller 120 to achieve the desired function of the device 10 overall. As understood by one skilled in the art, the motor controller 120 is operatively coupled to and acts as an intermediary between the power source 26, the motors 88 and the master control unit 122 in a closed or feedback control loop system.

A printed circuit board or PCB 130 having Hall-effect integrated circuit current sensors is electrically connected to the power source 26 and trigger 22 and is used to monitor the performance of the motors 88. In the embodiment shown, the current sensors are CZ-3724 current sensors from AKM. The PCB 130 also performs signal conditioning. The PCB 130 having the current sensors detects the electrical current to the motors 88 and generates an analog voltage or electrical signal that is proportional to or indicates or corresponds to an amount of electrical current being drawn by or provided to the motors 88. The analog voltage or electrical signal is sent to the master control unit 122. The master control unit 122 generates and sends a control signal, based upon the electrical signal received from the PCB 130, to the motor controller 120. The motor controller 120 controls or adjusts an amount of electrical current from the rechargeable battery 26 to drive the motors 88, including increasing or reducing or maintaining the electrical current, as a result of the control signal from the master control unit 122.

In one embodiment, the motor controller 120, the master control unit 122, and the PCB 130 are located in the upper body 30 of the device 10.

The master control unit or microcontroller 122 includes a physical programmable circuit board that is programmed or coded by a user. The master control unit 122 has input capabilities to monitor and process the electrical signals generated by the PCB 130 and the encoders 121, via the motor controller 120, and output capabilities to send control signals to the motor controller 120 based on the input signals and send real-time updates to a remote device (not shown). In an embodiment, the master control unit 122 is programmable with software to monitor, process and control, via the motor controller 120, in real-time, the electrical current to the motors 88 during actuation of the rotating mechanism 56.

The master control unit 122 may include wireless communication technology and/or high-speed connectivity to connect to and communicate or send or exchange data with remote devices, including local area networking devices or through the internet. The wireless technology and/or high-speed connectivity may be configured to communicate with remote servers or devices, including downloading or providing software updates to the device 10, downloading programming or code to the master control unit 122, and uploading or transmitting data or information from the master control unit 122 to remote servers or devices. The remote servers or devices may be accessible by a remote controller or user. In one embodiment, the remote controller or user can access and view real-time or live data or operating parameters on a remote monitoring dashboard as the tool is being used. In another embodiment, the remote controller or user controls or communicates with the device 10. The master control unit 122 communicates with the motor controller 120 to make adjustments to the motors 88 based on information from the PCB 130 and encoders 121 or other inputs, including remote inputs from remote controllers or users. The electrical signals monitored by the master control unit 122 may be stored as digital data, such as on the device 10 or on the remote server, such as a local server and/or a cloud-based server, and/or digitally communicated with the user.

Figure 8:
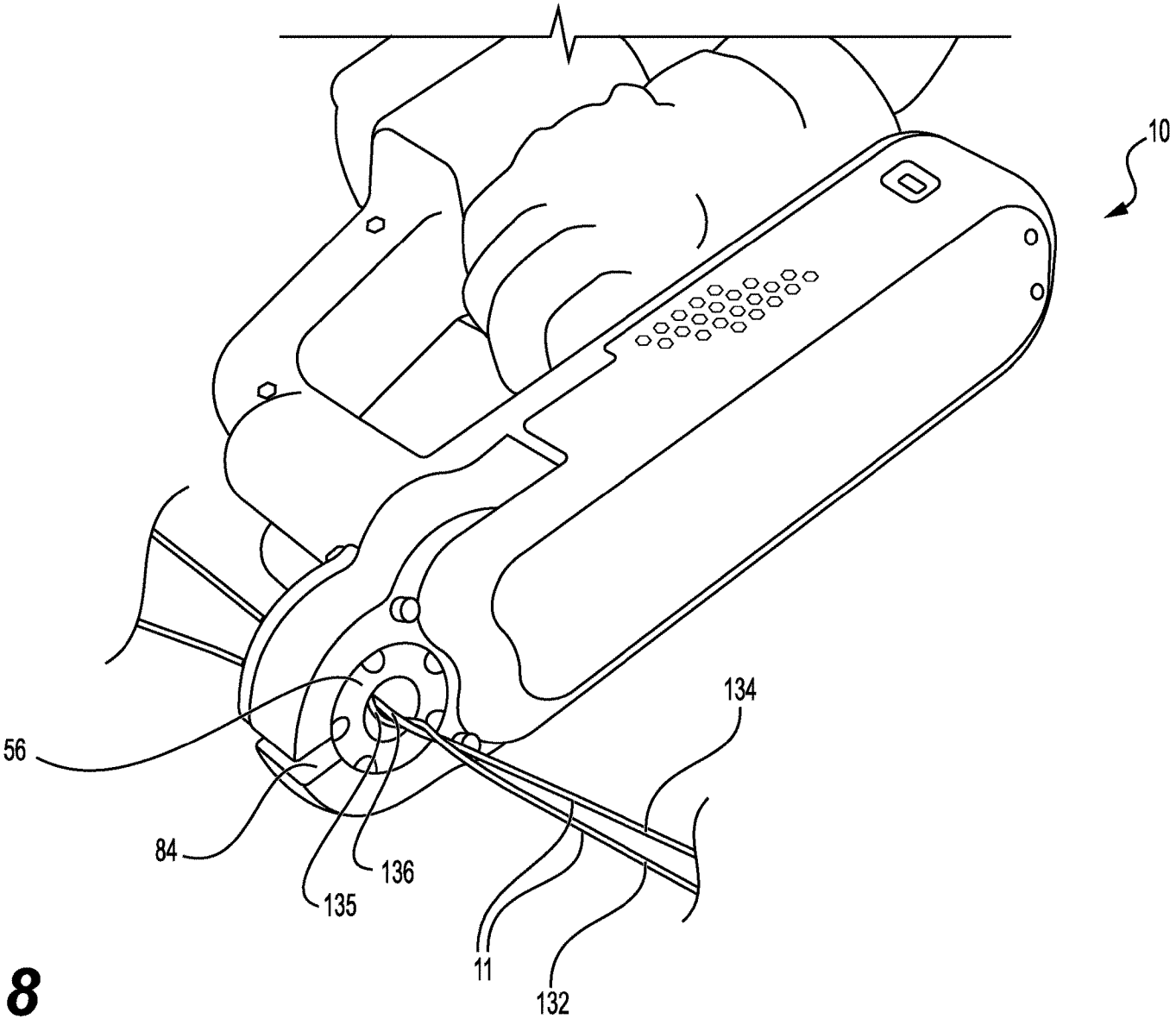
FIG. 8 illustrates a front, perspective view of the wire twisting device in FIG. 1, including two wires removably inserted into a groove of a rotating mechanism and the device being held by a user, in an embodiment.

In the embodiment shown in FIG. 8, the two wires 11 include a first wire 132 and a second wire 134. The first wire 132 and the second wire 134 are arranged parallel to each other and in proximity to each other along a longitudinal axis of the wires 132 and 134, and the ends of the first wire 132 and the ends of the second wire 134 are held taut at each end by securing mechanisms (not shown). The wire twisting device 10 is held adjacent approximate centers 135 and 136 of the first wire 132 and the second wire 134, respectively, the centers 135 and 136 positioned at approximately a midpoint between the ends of each wire 132 and 134. A user guides the opening 84 of the device 10 such that the center 135 of the first wire 132 extends through the approximate center 61 of the rotating mechanism 56 on a first side 137 of the separating member 62 and the center 136 of the second wire 134 extends through the approximate center 61 of the rotating mechanism 56 on a second side 138 of the separating member 62. Actuation of the device 10 causes the rotating mechanism 56 to rotate, twisting the two wires 11 about each other on each side of the device 10, such that the two wires 11 are twisted from the centers 135 and 136 or center twisted.

Different types of the twisted wires 11 may be used to hang parts on the picture frame racks for processing through the phosphoric acid anodizing line. The wires 11 may have different physical properties depending on the composition of the wires 11 and other physical characteristics of the wires 11, such as gauge. The physical properties and characteristics of the wires 11 affect how much the wires 11 may be twisted before the wires fail or break.

The master control unit 122 may be programmed to stop the motors 88 of the device 10 or to stop the twisting of the two wires 11, the two wires 11 being of the same composition and gauge and of a known composition and a known gauge, before the wires 11 fail or break. Predetermined data is programmed to the master control unit 122. The predetermined data includes information of a relationship between the electrical current to motors similar to the motors 88 and a corresponding applied torque with respect to an initial length and a number of twists of two wires of the same or similar composition and gauge as the two wires 11 being twisted. Additionally, predetermined data breakage information or a predetermined data set with respect to wire failure is programmed to the master control unit 122. The predetermined data breakage information includes a data set or a model or a function of the relationship of a calculated applied torque with respect to a number of twists and an initial length of two wires of the same or similar composition and gauge as the two wires 11 being twisted. Further, the predetermined data breakage information includes a breakage torque or a calculated applied torque or predetermined limit at which the two wires being twisted fail or break. The master control unit 122 compares real-time information from the PCB 130 and/or encoders 121 to the predetermined data information to calculate and estimate the real-time applied torque to the two wires 11. The master control unit 122 compares this estimated real-time applied torque of the two wires 11 being twisted to the predetermined data breakage information to predict the estimated real-time applied torque during twisting that will cause the two wires 11 to fail or break. Based on the estimated real-time applied torque of the two wires 11 being twisted in the device 10 and the calculated applied torque from the data breakage information, the master control unit 122 may then predict the increase in the estimated real-time applied torque over a period of twisting of the two wires 11 and send a control signal to stop or pause the twisting of the two wires 11 before the two wires 11 break. In one embodiment a safety applied torque factor may be applied to the predetermined calculated applied torque to ensure that the two wires 11 do not fail or break. It is foreseeable that a torque measurement subsystem or component could be used to directly measure the torque applied to the two wires 11 and that measured torque could be used to compare to the predetermined data information and the predetermined data breakage information.

In one embodiment the wire twisting device 10 is reprogrammable and may be programmed with predetermined data information and predetermined data breakage information for a second type of wire having a second composition and/or a second gauge, such that the device 10 may be used to twist two wires 11 of the second type of wire, with the master control unit 122 being enabled to stop the twisting of the two wires 11 before the wires 11 fail or are broken.

The master control unit 122 may be programmed to wirelessly monitor the health or performance of the device 10 and to wirelessly update the software or programming of the device 10. The wireless updates to the device 10 may be automatically downloaded to the device 10. Data regarding a failure of the device 10 and a mode of operation during the failure is saved or recorded, including uploading or sending the data to a remote server or device, such that trends can be examined and components identified that may be a likely cause of the failure. Safety protocols may be programmed to the master control unit 122 to avoid foreseeable failures of the wire twisting device 10, including automatically throttling the motors 88 via the motor controller 120 to lower the electrical current to the motors 88 to avoid overheating the motors 88. In one embodiment, programming of the master control unit 122 to monitor the health of the device 10 may include one or more of the following, as well as other device health monitoring programming: monitoring the electrical current of the motors 88; identifying when the motors 88 exceed or surpass a threshold or target electrical current, the target electrical current may include a target quantitative measure of electrical current and/or a target maximum amount of time or time limit that the motors are permitted to surpass a quantitative measure of electrical current; throttling the motors 88 to a lower electrical current when the target electrical current is surpassed; and stoppage or pausing of the motors 88. The target electrical current may be dependent on the composition and gauge of the two wires 11 and/or the motors 88. The throttling protects the motors 88 from overheating and may also be an alert or cautionary sign to a user. In a preferred embodiment, the master control unit 122 automatically sends a control signal to the motors via the motor controller 120 to throttle the motors 88 or stop the motors 88 when the target electrical current has been exceeded.

In some embodiments the models or functions relating to applied torque for different types of wires may be programmed to the master control unit 122 such that the master control unit 122 is able to make a predictive estimate regarding composition and gauge of an unknown wire to determine when to stop the motors before the two unknown wires 11 being twisted fail or break. As known by a person skilled in the art, applied torque of two wires may be calculated based on an initial wire length, a number of twists defining a double helix, a helix length and material properties of the wire. (A helix represents the centerline of a strand of wire.) The calculated applied torque as a function of the number of twists and the initial length of the wire, as used above to identify the applied torque that will cause the two wires 11 of a known composition to break during twisting, and first and second derivatives thereof, are unique for each composition of wire of a gauge at a given set of conditions. The master control unit 122 may be programmed with previously collected or predetermined calculated data sets for each type of wire that may be twisted in the wire twisting device 10. As the wire twisting device 10 is being used on unknown types of wires, the predetermined calculated data sets programmed to the master control unit 122 are compared to real-time data, including the estimated real-time applied torque values (estimated as a function of the measured electrical current) and a first derivative and second derivative of the estimated real-time torque values, calculated by the master control unit 122. Alternately, it is foreseeable that the real-time data could be measured with a direct torque measurement subsystem or component. The comparison of the real-time data to the predetermined calculated data sets determines or estimates the wire composition and gauge of the wire being twisted to predict when to terminate the device cycle or stop the motors 88 before a calculated applied torque from the data breakage information has been reached, avoiding excessive twisting or failure or breakage. Programming of predetermined calculated data sets allows for one wire twisting device to be used on various types of known and/or unknown wires, without reprogramming of the device 10. As detailed above, the master control unit 122 sends control signals, via the motor controller 120, to the motors 88 of the wire twisting device 10 based on the comparison of the real-time data to the predetermined data sets programmed in the master control unit 122 and is able to stop the motors 88 prior to the two wires 11 that are being twisted reaching a point of failure or breakage.

Figure 11A:
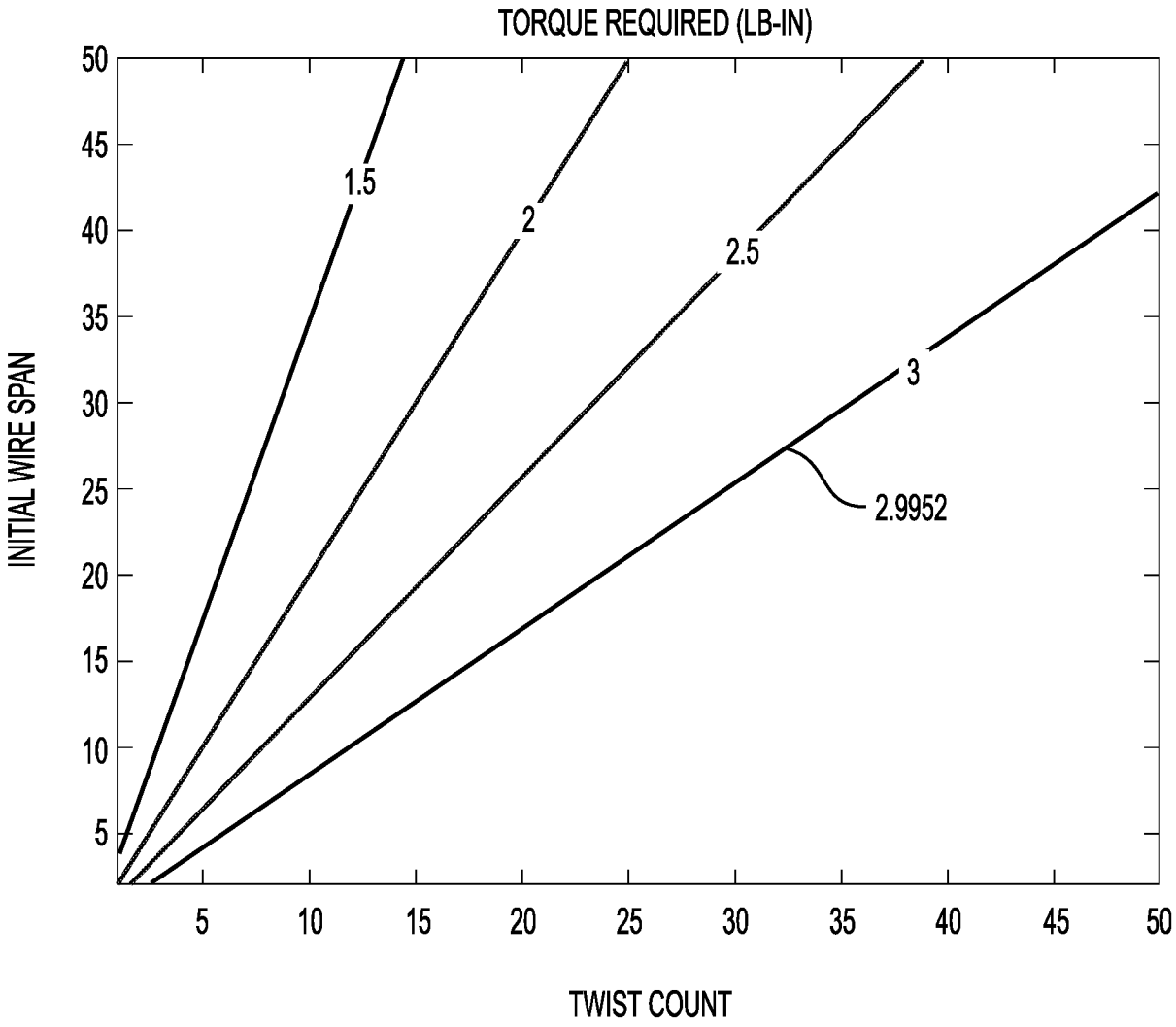
FIG. 11A is a contour plot of torque as a function of twist count and initial wire length for a 0.062-inch gauge aluminum wire, in an embodiment.
Figure 11B:
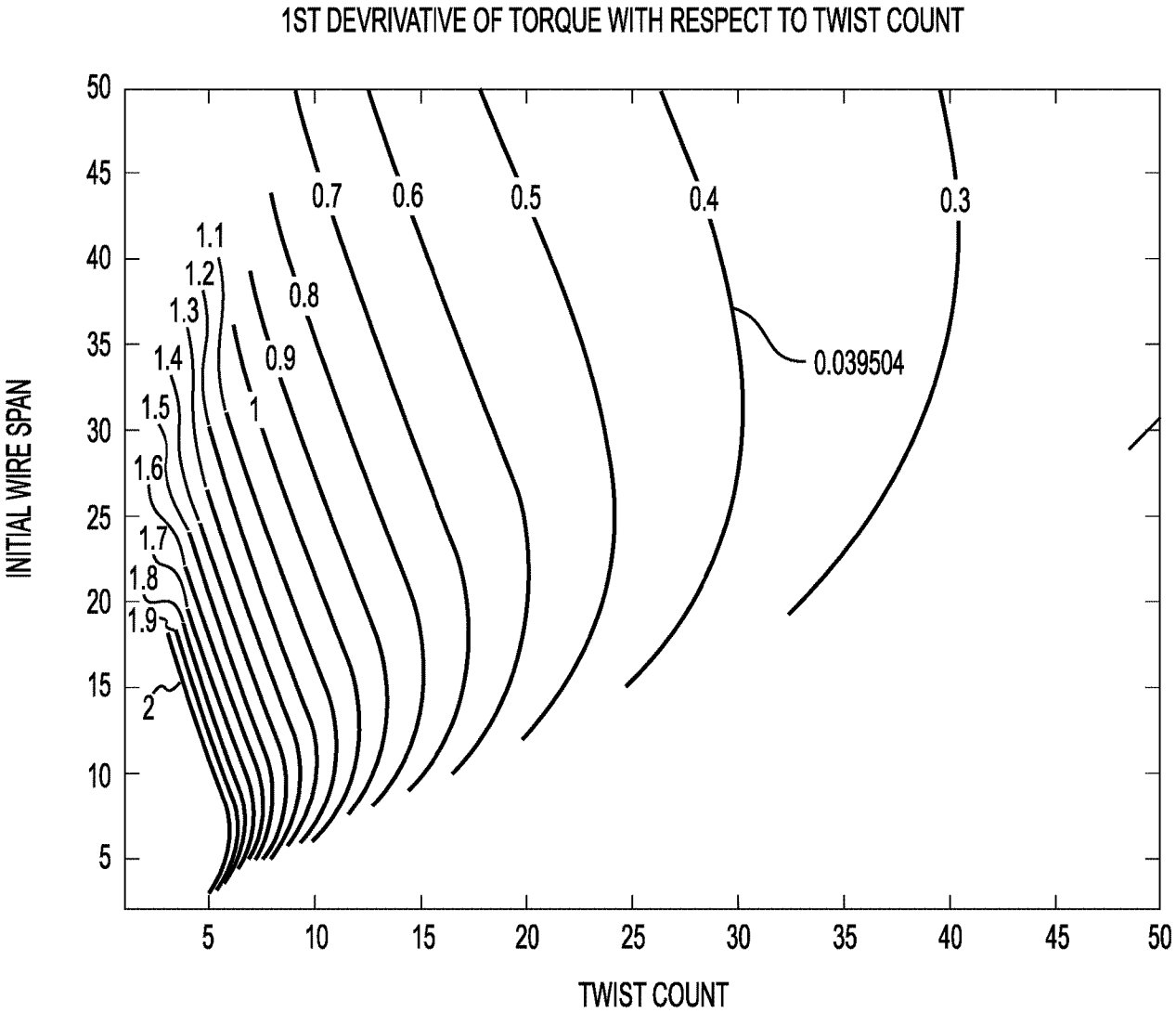
FIG. 11B is a contour plot of a first derivative of the data set of FIG. 11A of torque as a function of twist count and initial wire length, in an embodiment.
Figure 11C:
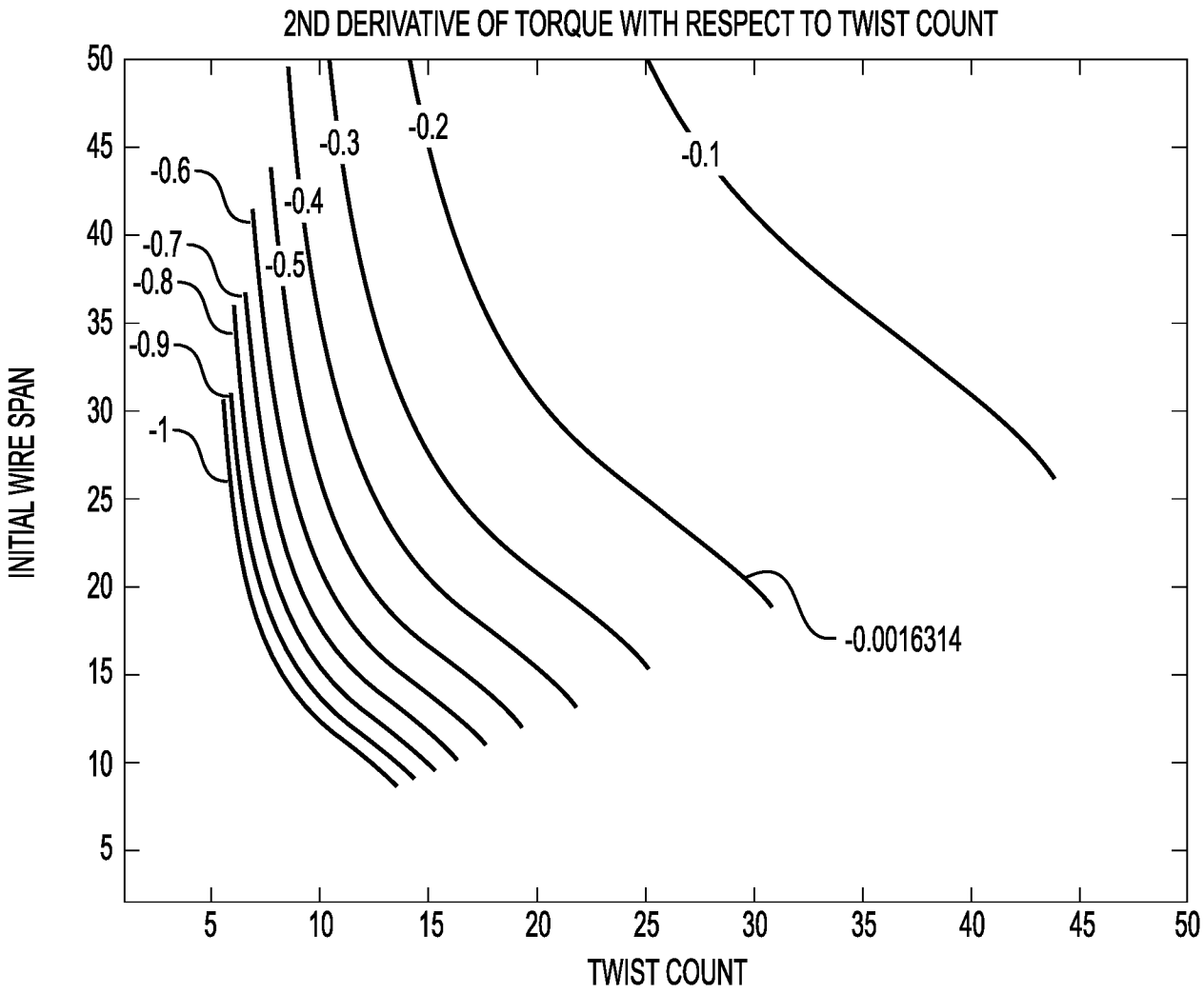
FIG. 11C is a contour plot of a second derivative of the data set of FIG. 11A of torque as a function of twist count and initial wire length, in an embodiment.
Figure 12A:
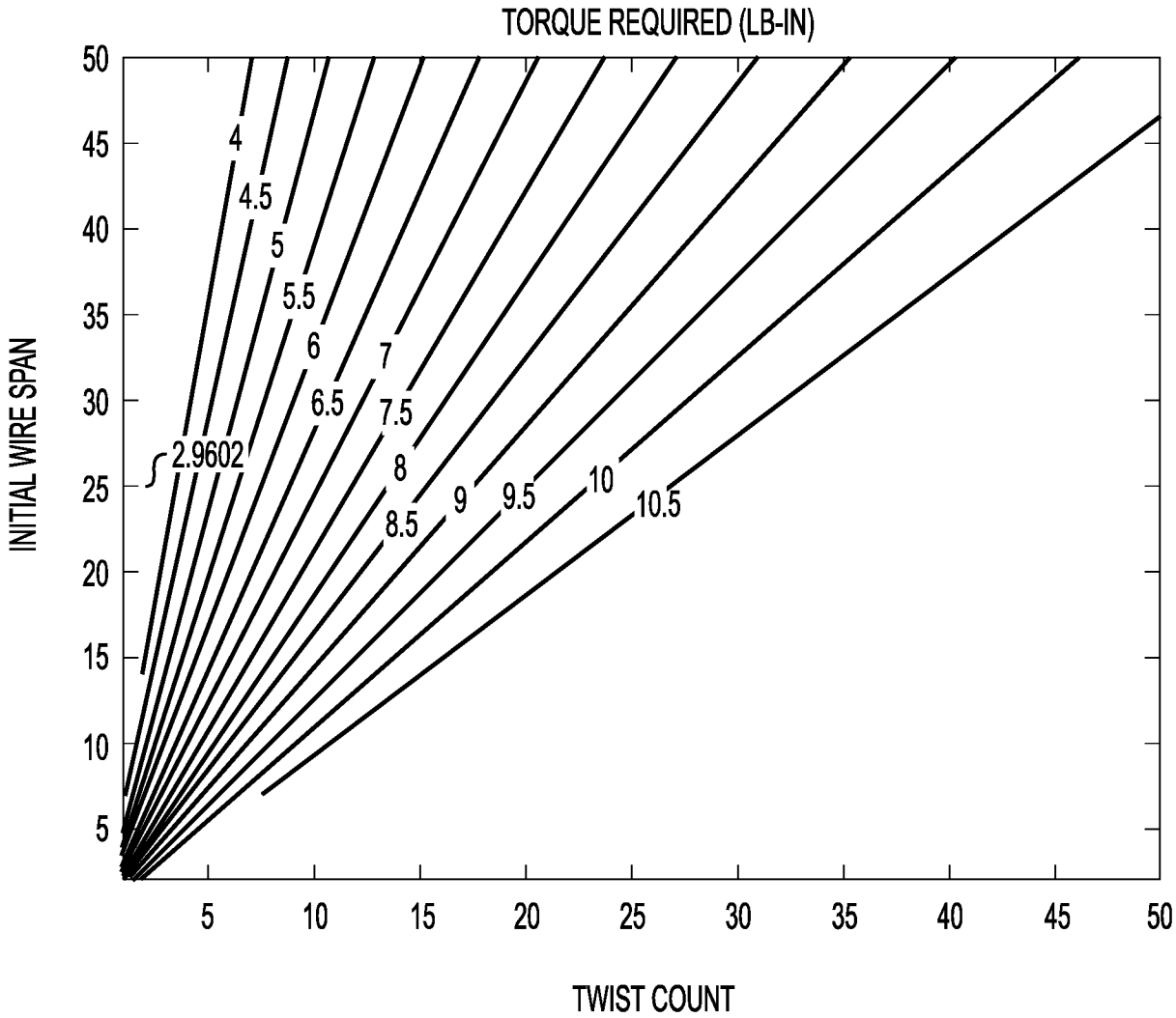
FIG. 12A is a contour plot of torque as a function of twist count and initial wire length for a 0.091-inch gauge aluminum wire, in an embodiment.
Figure 12B:
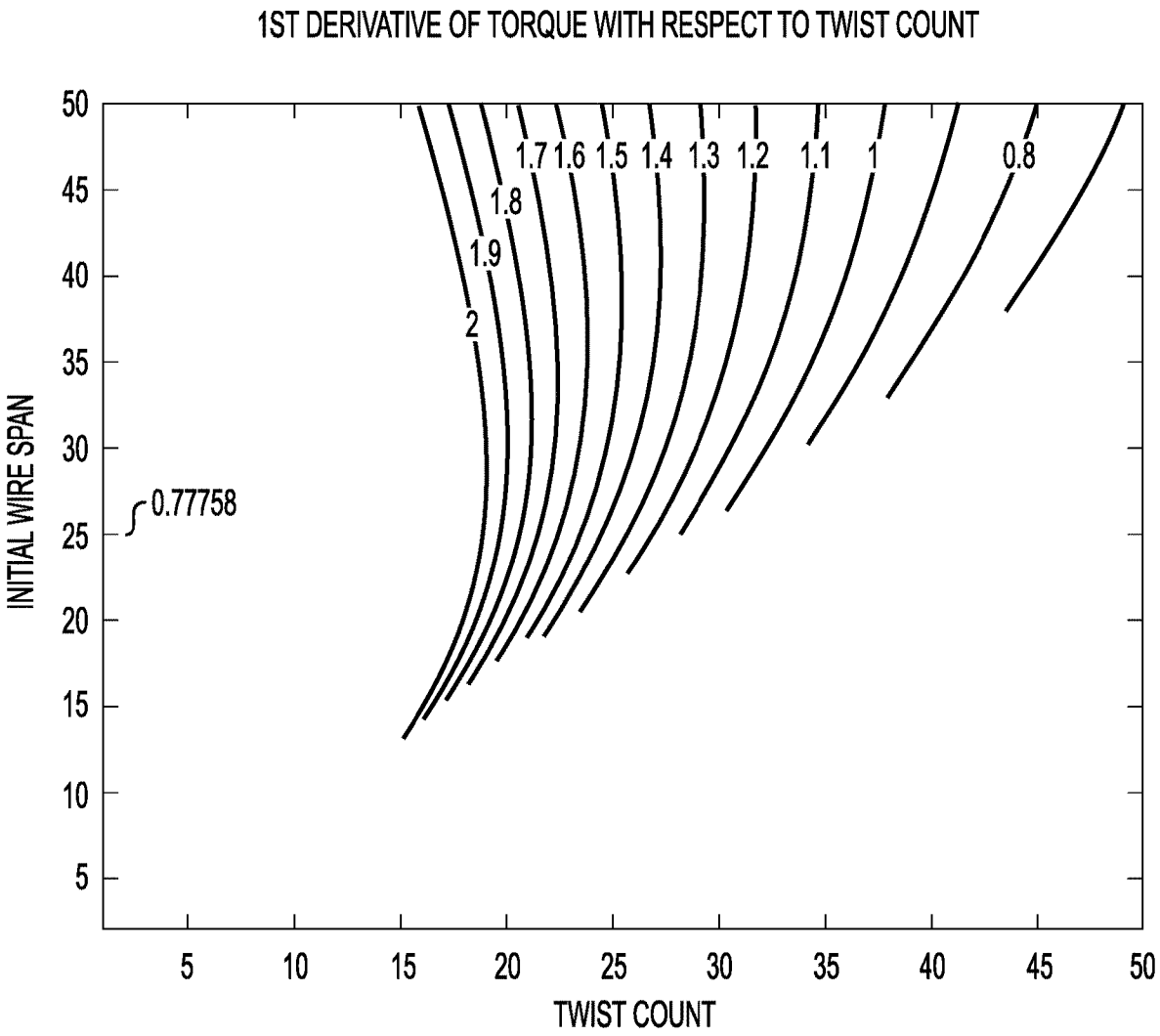
FIG. 12B is a contour plot of a first derivative of the data set of FIG. 12A of torque as a function of twist count and initial wire length, in an embodiment.
Figure 12C:
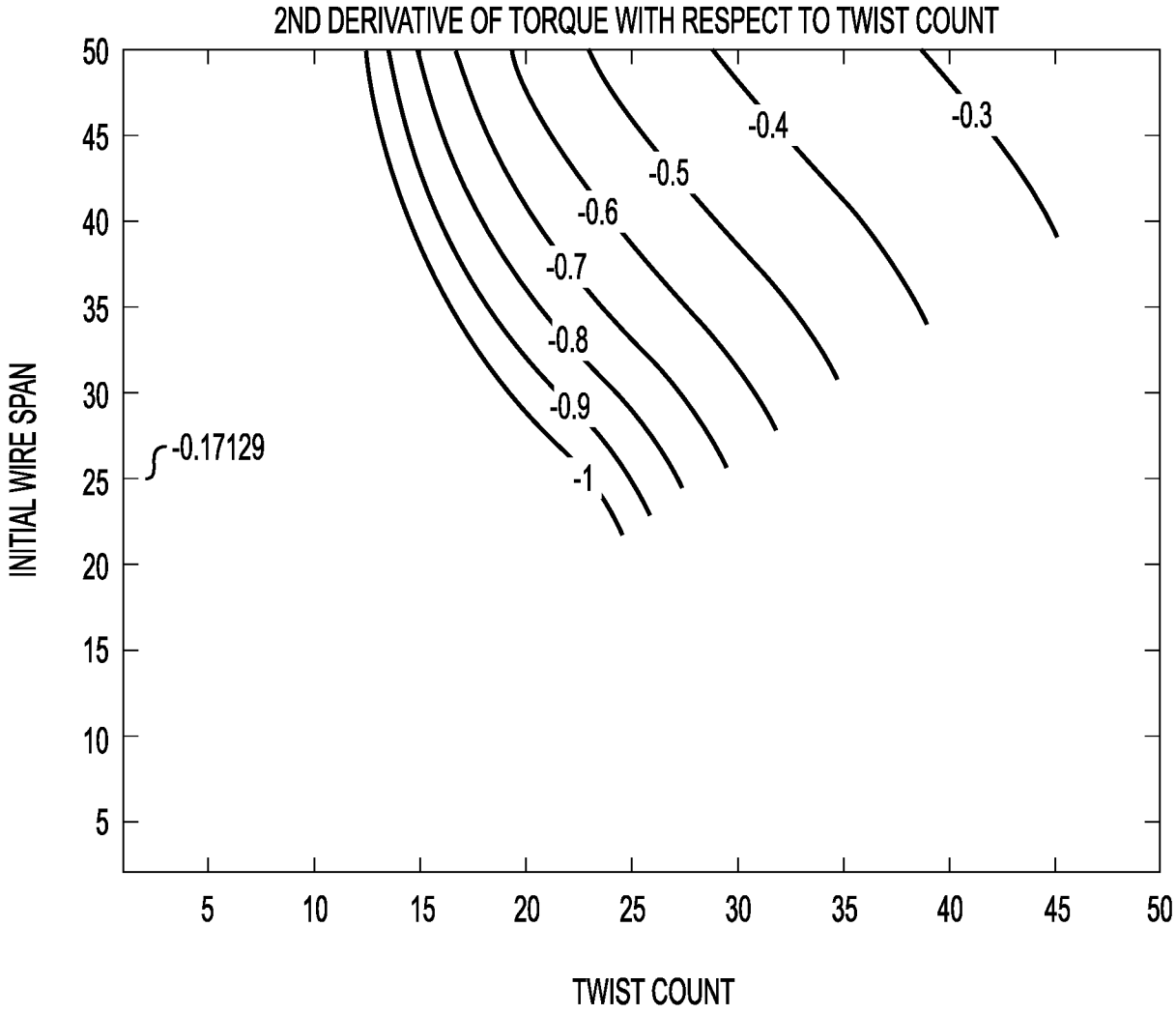
FIG. 12C is a contour plot of a second derivative of the data set of FIG. 12A of torque as a function of twist count and initial wire length, in an embodiment.

As an example of the data sets, FIGS. 11A, 11B, and 11C show contour plots of the relationship of applied torque as a function of the number of twists and the initial length of a 0.062-inch gauge wire at a given set of conditions. FIGS. 12A, 12B, and 12C show contour plots of the relationship of applied torque as a function of the number of twists and the initial length of a 0.091-inch gauge wire at a given set of conditions. FIGS. 11A and 12A show the torque required to be applied to twist the wires as a function of twist count and initial wire length. FIGS. 11B and 12B show the first derivative of the data of the applied torque with respect to twist count and initial wire length in FIGS. 11A and 12A, respectively. FIGS. 11C and 12C show the second derivative of the data of the applied torque with respect to twist count and initial wire length in FIGS. 11A and 12A, respectively. Corresponding data points are marked on each set of figures and are intended to illustrate how each data set uniquely characterizes a particular wire. Although the torque values shown on FIGS. 11A and 12A are both approximately 3 lb-in, the first and second derivatives of those respective conditions follow different trends and serve to differentiate the two different wires. The data sets illustrate that a static torque measurement is not enough to characterize a wire. The information regarding the change in torque value as the wire is twisted provides the information needed to identify or characterize a wire.

Figure 9:
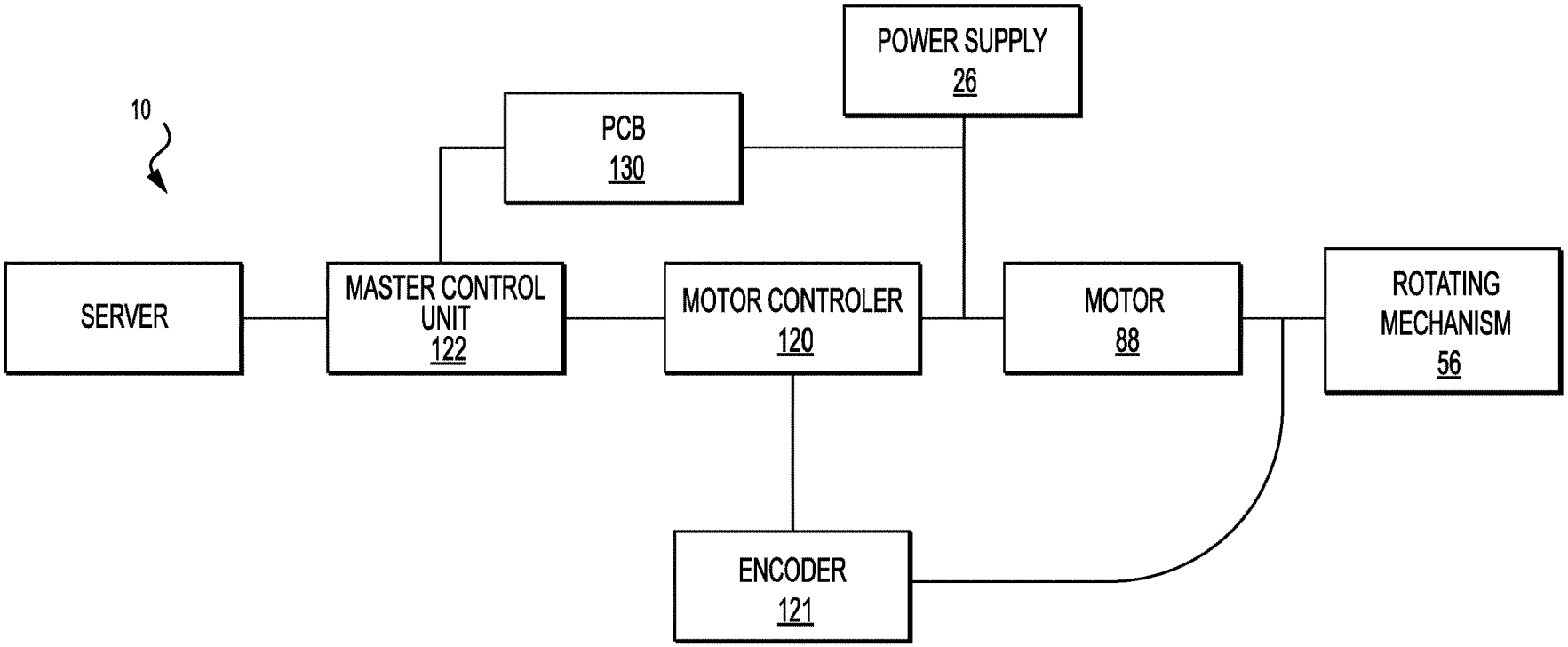
FIG. 9 is a system block diagram for an exemplary wire twisting device in FIG. 1, in an embodiment.

FIG. 9 is a system block diagram for an exemplary wire twisting device 10 with a master control unit 122. Lines connecting blocks of the diagram indicate signal pathways, which may include redundant signal pathways (e.g., duplicate or triplicate independent signal pathways).

Figure 10:
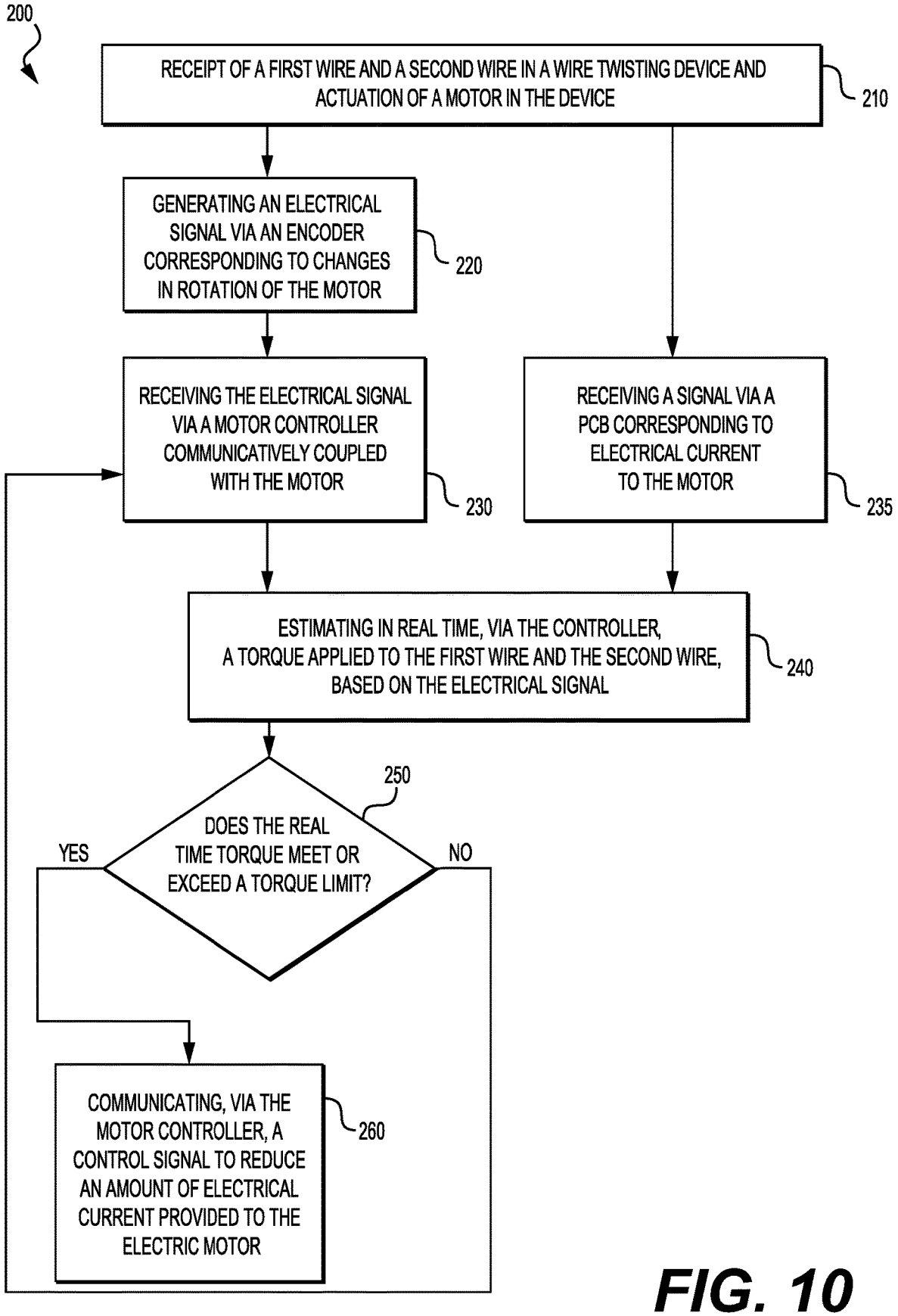
FIG. 10 is a flowchart of an exemplary method for twisting two wires with the wire twisting device in FIG. 1, in an embodiment.

FIG. 10 is a flowchart of an exemplary method 200 for twisting two wires 11 with a wire twisting device 10. At step 210, the two wires 11, including a first wire 132 and a second wire 134, are received by the wire twisting device 10 and a motor 88 of the device 10 is actuated. At step 220, an encoder 121 generates an electrical signal corresponding to changes in rotation of the motor 88. At step 230, a master control unit 122 receives the electrical signal via a motor controller 120. At step 235, the master control unit 122 receives a signal via a PCB 130 that corresponds to the electrical current to motors 88. At step 240, the master control unit 122 measures or estimates in real time a torque applied to the first wire 132 and the second wire 134 based on the signal from the PCB 130. At step 250, the master control unit 122 determines whether the real-time, applied torque exceeds a torque limit or breakage torque, the breakage torque being part of predetermined calculated breakage data information programmed to the master control unit 122. The breakage torque may include a safety torque factor. If the applied torque meets or exceeds the breakage torque, the master control unit 122 communicates, via the motor controller 120, a control signal to reduce or stop the amount of electrical current provided to the electric motor 88 which stops the rotating mechanism 56 mechanically coupled to the motor 88 from rotating in step 260. If the applied torque does not meet or exceed the breakage torque, the device 10 continues to twist the two wires 11 about one another until either the master control unit 122 determining that the applied torque is approximately equal to or exceeds the breakage torque or a user releases the trigger 22. Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A wire twisting device, comprising:

a driven rotating mechanism having a groove, wherein the groove comprises a first side and a second side configured to receive a first wire and a second wire, respectively;

an electric motor associated with an encoder, wherein the encoder is configured to generate an electrical signal corresponding to changes in rotation of the electric motor;

a drive gear mechanically coupled with the electric motor for rotating the driven rotating mechanism, wherein the driven rotating mechanism is configured to twist the first wire and the second wire about one another;

a current sensor on a printed circuit board configured to detect an electrical current to the electric motor and generate a voltage that corresponds to the amount of electrical current; and a control unit configured to perform steps comprising:

receiving the electrical signal generated by the encoder;

receiving the voltage generated by the current sensor;

determining an amount of torque applied to the first wire and the second wire; and when the amount of torque exceeds a predetermined limit, communicating a control signal to reduce the electrical current provided to the electric motor.

2. The wire twisting device of claim 1, further comprising: a handle configured to be held in a user's hand, a selectively operable trigger inside the handle for actuating the electric motor, and a rechargeable battery for powering the device.

3. The wire twisting device of claim 2, further comprising a motor controller operatively coupled to the rechargeable battery, the electric motor and the control unit, wherein the motor controller controls the amount of electrical current from the rechargeable battery to the electric motor based on a control signal received from the control unit.

4. The wire twisting device of claim 3, wherein communicating a control signal to the electric motor comprises communicating a control signal from the control unit to the motor controller to stop the rotation of the driven rotating mechanism prior to failure of the first wire and the second wire.

5. The wire twisting device of claim 1, wherein the predetermined limit is configured to prevent failure of the first wire and the second wire.

6. The wire twisting device of claim 1, wherein the control unit is configured to further perform:

predicting when to reduce the electrical current provided to the electric motor prior to reaching the predetermined limit, comprising:

calculating a real-time estimate of applied torque; and comparing the real-time estimate of applied torque to the predetermined limit.

7. The wire twisting device of claim 6, wherein the real-time estimate of applied torque is based on factors comprising:

an initial length of the first wire and the second wire;

a gauge of the first wire and the second wire; and a real-time number of twists in the first wire and the second wire.

8. The wire twisting device of claim 7, wherein the real-time estimate of applied torque comprises a first derivative of the real-time estimate of applied torque.

9. The wire twisting device of claim 8, wherein the real-time estimate of applied torque comprises a second derivative of the real-time estimate of applied torque.

10. The wire twisting device of claim 1, further comprising wireless communication technology configured to communicate with a remote device.

11. The wire twisting device of claim 10, wherein the remote device is a server, and the wireless communication technology is configured to transmit data from the control unit to the server for recording.

12. The wire twisting device of claim 10, wherein the remote device is a server, and the server is configured to provide software updates to the control unit via the wireless communication technology.

13. A method of twisting wire with a wire twisting device, comprising:

receiving a first wire and a second wire in the wire twisting device, the device having an electric motor configured for rotating a driven rotating mechanism, wherein the driven rotating mechanism comprises a groove having a first side and a second side configured to receive the first wire and the second wire, respectively;

generating an electrical signal via an encoder, wherein the electrical signal indicates changes in rotation of the electric motor;

generating a voltage via a printed circuit board having an integrated circuit current sensor, wherein the voltage corresponds to an electrical current to the electric motor;

receiving the electrical signal via a motor controller communicatively coupled with a control unit, a power supply and the electric motor;

receiving the voltage via the control unit communicatively coupled with the motor controller;

estimating in real time, via the control unit, an amount of torque applied to the first wire and the second wire based on the voltage; and communicating, via the control unit, a control signal for reducing the amount of electrical current provided to the electric motor.

14. The method of twisting wire of claim 13, further comprising predicting when to stop rotation of the driven rotating mechanism prior to failure of the first wire and the second wire, wherein predicting comprises:

determining a torque limit in real time;

comparing via the control unit, the amount of torque estimated in real time with the torque limit determined in real time; and communicating a control signal to the electric motor for stopping rotation of the driven rotating mechanism prior to the amount of torque estimated being approximately equal to the torque limit.

15. The method of twisting wire of claim 14, wherein determining the torque limit in real time is based on a predetermined data set of applied torque for wire failure, wherein the predetermined data set of applied torque for wire failure is based on an initial length of the first wire and the second wire, a gauge of the first wire and the second wire, and a number of twists in the first wire and the second wire.

16. The method of twisting wire of claim 15, wherein the predetermined data set of applied torque for wire failure is based on a first derivative of the applied torque as a function of the number of twists and the initial length of wire, and a second derivative of the applied torque as a function of the number of twists and the initial length of wire.

17. The method of twisting wire of claim 13, further comprising monitoring performance of the wire twisting device, including:

estimating an electrical current to the electric motor based on the voltage generated by the current sensor; and comparing the estimated electrical current to the electric motor with a target electrical current.

18. The method of twisting wire of claim 17, wherein communicating a control signal to reduce the amount of electrical current comprises communicating a control signal to reduce the electrical current to the electric motor when the estimated electrical current is approximately equal to or surpasses the target electrical current.

19. The method of twisting wire of claim 13, wherein estimating in real time the amount of torque is based on an initial length of the first wire and the second wire, a gauge of the first wire and the second wire, and a real-time number of twists in the first wire and the second wire.

20. The method of twisting wire of claim 19, wherein estimating in real time the amount of torque is based on a first derivative of the estimated applied torque as a function of the number of twists and the initial length of wire, and a second derivative of the estimated applied torque as a function of the number of twists and the initial length of wire.

* * * * *